US006494241B2

(12) United States Patent
Biancaniello et al.

(10) Patent No.: US 6,494,241 B2
(45) Date of Patent: Dec. 17, 2002

(54) BRIDAL ACCESSORY APPARATUS

(76) Inventors: Donna Biancaniello, 1365 Pond View La., Newtown Square, PA (US) 19073; Christine Galante, 1056 W. Boot Rd., Downingtown, PA (US) 19335; Mary Harden, 5500 Homeville Rd., Oxford, PA (US) 19363

( * ) Notice: Subject to any disclaimer, the term of this patent is extended or adjusted under 35 U.S.C. 154(b) by 0 days.

(21) Appl. No.: 09/833,293

(22) Filed: Apr. 12, 2001

(65) Prior Publication Data

US 2002/0150312 A1 Oct. 17, 2002

(51) Int. Cl.[7] ..... A45C 13/18
(52) U.S. Cl. ..... 150/102; 47/41.01
(58) Field of Search ..... 224/217, 218, 224/219, 220, 221; 150/102, 107, 134; D3/246; 47/41.01, 41.1, 41.11, 41.12, 41.13, 41.15

(56) References Cited

U.S. PATENT DOCUMENTS

| | | | | | |
|---|---|---|---|---|---|
| 114,404 | A | * | 5/1871 | Brown, Jr. | 224/217 |
| 214,823 | A | * | 4/1879 | Hopkins | 224/218 |
| 475,503 | A | * | 5/1892 | Hock | 150/102 |
| 1,624,407 | A | * | 4/1927 | Hamilton | 47/41.01 |
| 2,563,202 | A | * | 8/1951 | Wurzlow | 47/41.11 |
| 2,711,202 | A | | 6/1955 | Freedman | |
| 3,651,601 | A | | 3/1972 | LaMontagne | |
| 3,942,693 | A | * | 3/1976 | Tocci | 150/102 X |
| 4,204,365 | A | | 5/1980 | Hirvi | |
| 4,566,221 | A | | 1/1986 | Kossin | |
| 5,070,644 | A | | 12/1991 | Hasty | |
| 5,127,545 | A | | 7/1992 | French | |
| 5,413,126 | A | | 5/1995 | Revson | |
| 5,693,386 | A | | 12/1997 | Cheng | |

FOREIGN PATENT DOCUMENTS

| | | | | |
|---|---|---|---|---|
| GB | 110611 | * | 10/1917 | 224/218 |

* cited by examiner

*Primary Examiner*—Jes F. Pascua
(74) *Attorney, Agent, or Firm*—Massinger Law Office

(57) ABSTRACT

A bridal accessory apparatus is comprised of an enclosure capable of holding therein important personal items such as cosmetics, facial tissues and mints in a secure fashion and further being capable of removable attachment to conventional bridal bouquet holders of the prior art. The enclosure is sized to remain hidden behind the head member of such bouquet holders when suspended from the neck region thereof using a variety of attachment means. Thusly positioned, the subject apparatus is relatively hidden from view by wedding guests and photographers and may be inconspicuously carried by members of the bridal party during the wedding ceremony, photograph sessions, and other critical time periods during the wedding day. Means for preventing axial displacement of the enclosure along the handle of the bouquet holder are also described. In another embodiment, the bouquet holder itself is modified to retain those items of importance to the bridal party.

3 Claims, 4 Drawing Sheets

BRIDAL ACCESSORY APPARATUS

FIELD OF THE INVENTION

The subject invention relates to an accessory item for members of a bridal party, in general, and to a decorative temporary storage apparatus for use with bouquets intended to be carried by hand, in particular.

BACKGROUND OF THE INVENTION

During the course of a wedding day members of the bridal party, comprised of the bride-to-be, maid or matron of honor and bridesmaids, almost certainly find themselves in circumstances where access to their purse or handbag is impractical or impossible. A few such circumstances, for instance, are immediately prior to and during the wedding ceremony, during photographic sessions, and during their introduction at the wedding reception. Ironically, it is during these critical time periods when bridal party members will want to look and feel their best, but access to the articles within their handbags, such as lipstick and other makeup items, facial tissues, a small mirror, breath mints and the like, is limited. Some brides have even been known to want smelling salts close by during what may be considered a highly stressful, albeit happy event.

Rather than a handbag and the essentials carried therein, members of the bridal party will typically be in possession of a flower bouquet during most of the day. The bouquet is usually held with both hands at approximately elbow level in front of the carrier. In many instances, flowers are suspended in a cascading fashion from the head of the bouquet holder. The construction of a conventional hand held flower bouquet holder is described in U.S. Pat. No. 5,070,644 issued to Hasty in 1991, as comprising a head with an element for holding the stems of a bouquet of flowers and an elongate, rigid, plastic handle for holding the bouquet. Numerous variations of this general design have been taught in the prior art such as those described in U.S. Pat. No. 4,204,365 issued to Hirvi in 1980 and U.S. Pat. No. 4,566,221 issued to Kossin in 1986. The Hirvi reference teaches, inter alia, a bouquet holder having a flexible handle which conforms to the hand of its holder. The Kossin reference teaches a holder having a head adapted with moisture retention and flower stem retention means. Numerous other variations of this basic design may also be found in the prior art.

It is clear that a significant need exists among members of a bridal party for carrying essential personal items in an inconspicuous manner during the wedding ceremony and at other important times during the wedding day, and without interfering with the carrying of their wedding bouquets.

SUMMARY OF THE INVENTION

The subject invention meets the needs of bridal party members by providing a means for carrying necessary personal items during the wedding day in an inconspicuous manner. More particularly, the subject bridal accessory apparatus is comprised of an enclosure capable of holding therein important personal items in a secure fashion and further being capable of temporary attachment to conventional bridal bouquet holders of the prior art. The enclosure is sized to remain hidden behind the head member of such bouquet holders when suspended from the neck region thereof using a variety of attachment means. Thusly positioned, the subject apparatus is relatively hidden from view by wedding guests and photographers. Means for preventing axial displacement of the enclosure along the handle of the bouquet holder are also described herein. In another embodiment, the bouquet holder itself is modified to retain those items of importance to the bridal party.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is, therefore, a primary object of the subject invention to provide a bridal accessory apparatus capable of holding therein items of importance to bridal party members such as cosmetics, facial tissues, a compact mirror, mints, and the like.

Another primary object of the subject invention is provide means for carrying the above items in an inconspicuous manner, such that the apparatus as a whole is essentially hidden from view by wedding guests and photographers, but which is fashionably designed so as to serve as a keepsake item for the bride and bridesmaids.

It is also an object of the present invention to provide a bridal accessory apparatus having means for removable attachment to conventional bouquet holders.

It is another object of the present invention to provide a bridal accessory apparatus having means for preventing axial displacement of the apparatus along the handle of a bouquet holder.

Still another object of the present invention is to provide a bridal accessory apparatus that is simple in its construction and therefore easily manufactured in mass quantities and relatively inexpensive to the consumer.

These together with other objects of the invention, along with the various features of novelty which characterize the invention, are pointed out with particularity in the claims annexed to and forming a part of this disclosure. For a better understanding of the invention, its advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
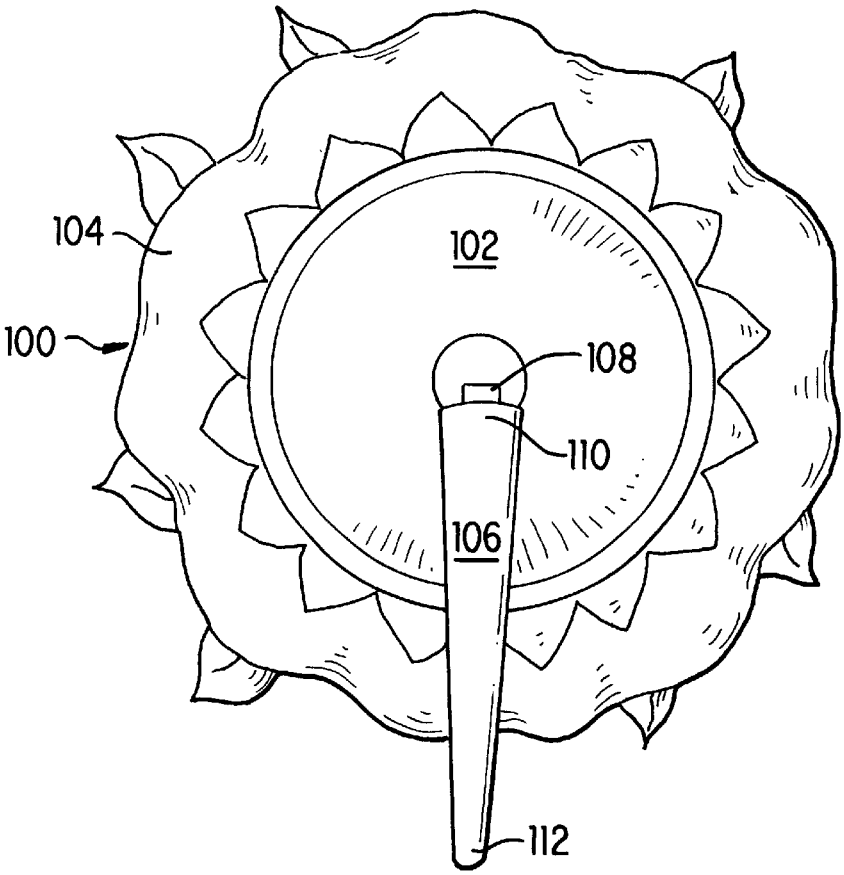
FIG. 1 illustrates a rear view of a conventional bridal bouquet and bouquet holder, together with a first embodiment of the subject bridal accessory device.
Figure 1:
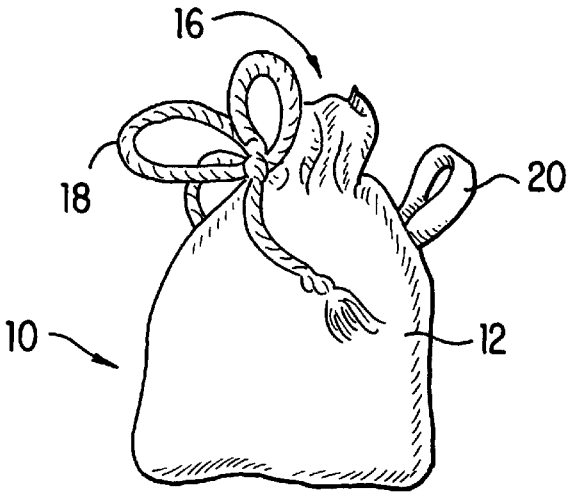

Reference is now made to FIG. 1 in which there is illustrated a first embodiment of the subject bridal accessory device designated generally by reference numeral 10, together with a conventional bridal bouquet and bouquet holder together designated generally by reference numeral 100 and shown in rear view.

Before the subject invention and its advantages can be fully appreciated, it is first necessary to understand the construction of a conventional bouquet holder. Bouquet holder 100 is comprised of a head portion 102 with an element (not shown) for holding the stems of a bouquet of flowers 104 and an elongate, rigid, plastic handle 106 for holding the bouquet 100 by the bridal party member. Head 102 is comprised of substantially solid plastic conical wall adapted with means for retaining flowers 104 in place. The elongate handle 106 is integrally joined to a narrow part of the conical wall opposite the flower retention means and extends away therefrom in a direction forming an obtuse angle relative to the major axis of the conical wall. A neck juncture 108 is narrowed relative to the elongate handle and is situate between head 102 and the proximal end 110 of handle 106. Handle 106 is typically widest at proximal end 110 and gradually tapers in width to its narrowest width at its free distal end 112. Handle 10 and head 102 may be integrally molded together or manufactured as two separate but attachable components, typically for ease in stacking and shipping. Both components are usually molded from a suitable plastic such as polyethylene or styrene.

The first embodiment of the subject bridal accessory apparatus 10 as illustrated in FIG. 1 is comprised of two primary components. First, an enclosure 12 defines an open space 14 (not shown) therein and has an opening 16 located at the top of the enclosure. As should be obvious, articles of importance to bridal party members may be inserted through opening 16 and into open space 14 of enclosure 12 for temporary storage during the wedding day. As heretofore mentioned, such articles may include, for instance, lipstick and other cosmetics, a compact mirror, facial tissues, breath mints, smelling salts, cigarettes and lighter, hair pins and compact brush or comb. Because the subject bridal accessory apparatus is designed for use in circumstances in which aesthetic considerations are important, it will typically be constructed of fabrics which closely match or compliment the wedding gown and bridesmaid dresses in both color and quality. The aesthetic appearance of the subject apparatus may be enhanced with lace, ribbon, sequins, or other such decorative items which are well known to those skilled in the art. Although the subject apparatus is not intended to be viewed by the wedding guests or photographers during critical time periods of the wedding day, its ornamental appearance makes it an ideal keepsake for the bride and her bridesmaids. Additional secondary structural components may include closure means 18 which, in the embodiment illustrated, is comprised of an ornamental draw string with tasseled ends. It is important to recognize that in addition to the pouch-like embodiment with draw string depicted herein, other shaped enclosures and closure means are also contemplated. To that end, for example, enclosure 12 may be comprised of one or more pieces of fabric or other suitable material which may define a variety of shapes and levels of rigidity. The enclosure may be constructed to have a defined bottom panel for instance. Closure means 18 may also be comprised of flaps, snaps, or other means customary in the art.

While the shape of the subject invention is not critical, size is an important feature. The number of articles capable of being stored in the open space 14 is, of course, limited by their size as well as that of the enclosure 12. With regard to the latter, reference is now made to FIGS. 2A and 2B wherein the subject apparatus is illustrated in phantom lines behind frontal and side views, respectively, of bouquet 100. Note that enclosure 12 is sized to be relatively hidden from view when attached to bouquet holder 100 in the manner described below. This is an important feature of the subject invention in that it is a primary object thereof to create a means of storing items essentially out of view by the wedding guests and photographers so as not to interfere with or otherwise clutter the overall appearance of the bridal party. The subject bridal accessory apparatus 10 is shielded from view by head 102 and flowers 104 of the bouquet when held in the traditional fashion using handle 106. The greatest length of the subject apparatus then should be no greater than the diameter "d" of the bouquet as observed from a frontal perspective.

Figure 2A:
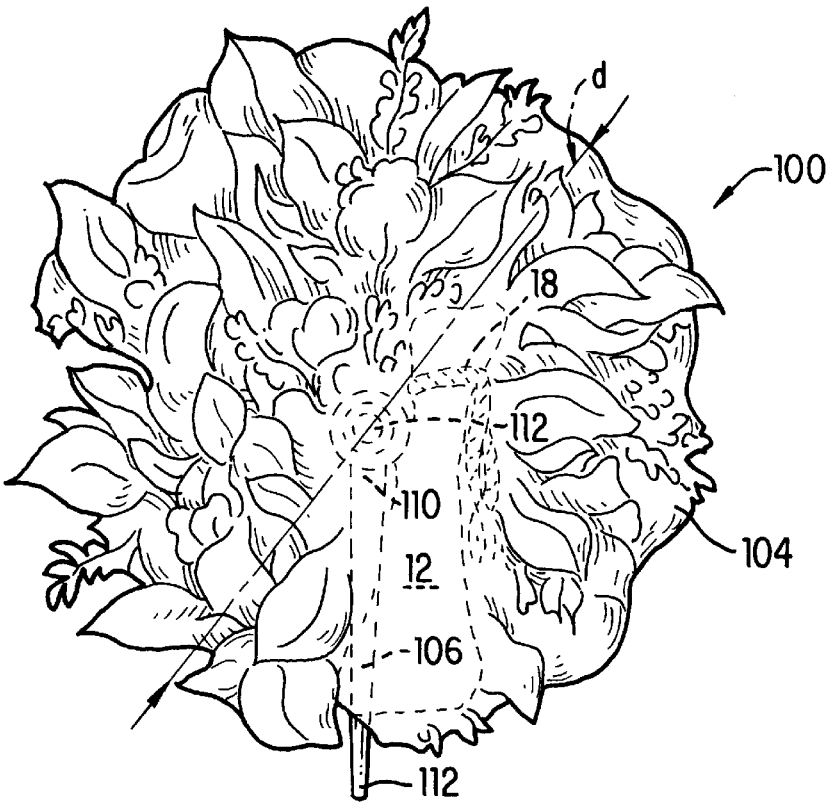
FIG. 2A is a frontal view of the subject apparatus depicted in phantom view to demonstrate how it may be hidden from view behind a flower bouquet which is also shown in frontal view.
Figure 2B:
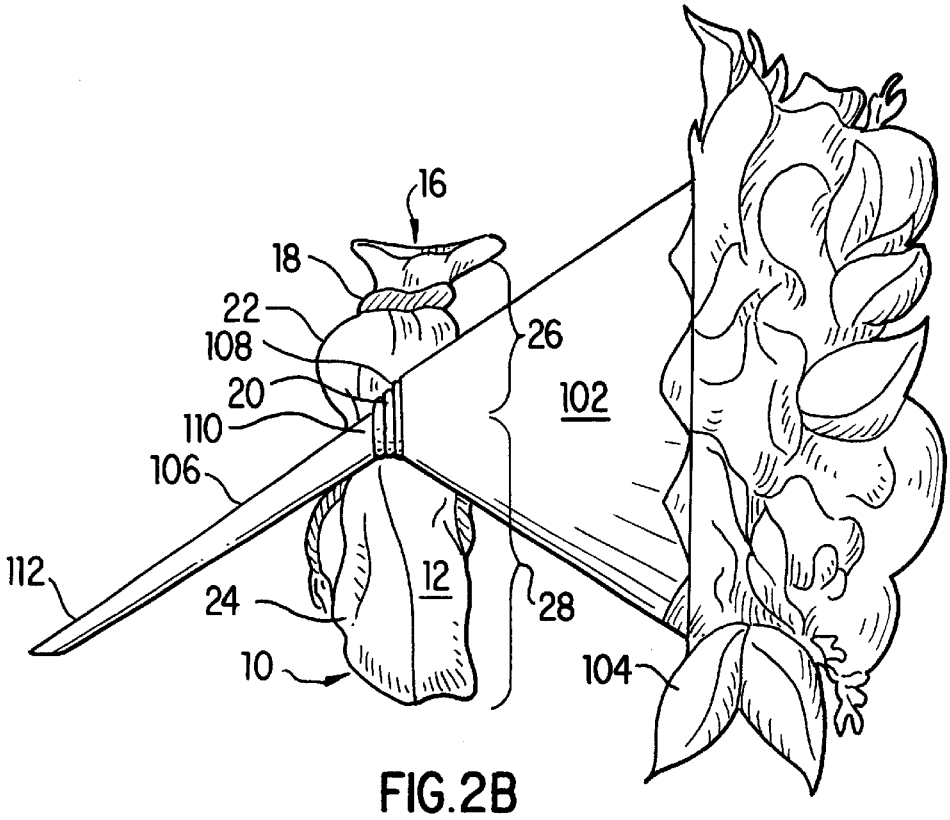
FIG. 2B is a side view of the invention of FIG. 2A illustrating its attachment to the neck portion of a conventional bouquet holder and further depicting retention means for preventing axial displacement of the apparatus from the bouquet holder handle.

The second primary component of the subject bridal accessory apparatus is attachment means 20 which in FIGS. 1 and 2A–B is comprised of an elastic band capable of slidable insertion along the longitudinal axis of handle 106 until positioned around neck juncture 108. Attachment means 20 should be sized so as to snugly fit around handle 106 generally, and neck juncture 108 particularly. It is preferred that each end of the elastic band be connected to the exterior surface of enclosure 12 at the same location thereby forming a continuous elastic loop. Moreover, attachment means 20 is fixedly attached to the exterior of enclosure 12, preferably at a location between the top 22 and bottom 24 of the enclosure, thereby defining a first portion 26 of enclosure 12 above the attachment means and a second portion 28 below same. Note from FIGS. 2A and 2B that said first portion 26 of the enclosure will occupy space above its point of attachment; namely at neck juncture 108 and said second portion 28 of the enclosure will occupy space below the same. When constructed in this fashion, a greater amount of items may be stored in apparatus 10 while still remaining out of the audience's view. It is preferred that items of lesser weight be stored in the first portion 26 of the enclosure to avoid drooping.

Once the subject bridal accessory apparatus is in place on bouquet holder 100, optional retention means 30 may be utilized to prevent axial displacement or "slippage" of attachment means 20 down handle 106. Retention means 30, therefore, prevent the apparatus from falling off the bouquet holder which would be a cause of embarrassment and/or distraction. In the embodiment illustrated, retention means 30 is comprised of a biased clip 32 capable of temporary attachment onto head 102 of bouquet holder 100 and permanently connected to the interior of enclosure 12 via cord 34. When not in use, clip 32 and cord 34 may be stored inside of the enclosure and out of sight. Additionally, it may be observed that retention means 30 also serves to anchor the first portion 26 of enclosure 12 in an upright position and appreciated that such means of preventing axial displacement will be even more useful when used with bouquet holders which do not have a narrowed neck region. Other retention means may also be employed, the embodiment described herein being merely illustrative.

Figure 3:
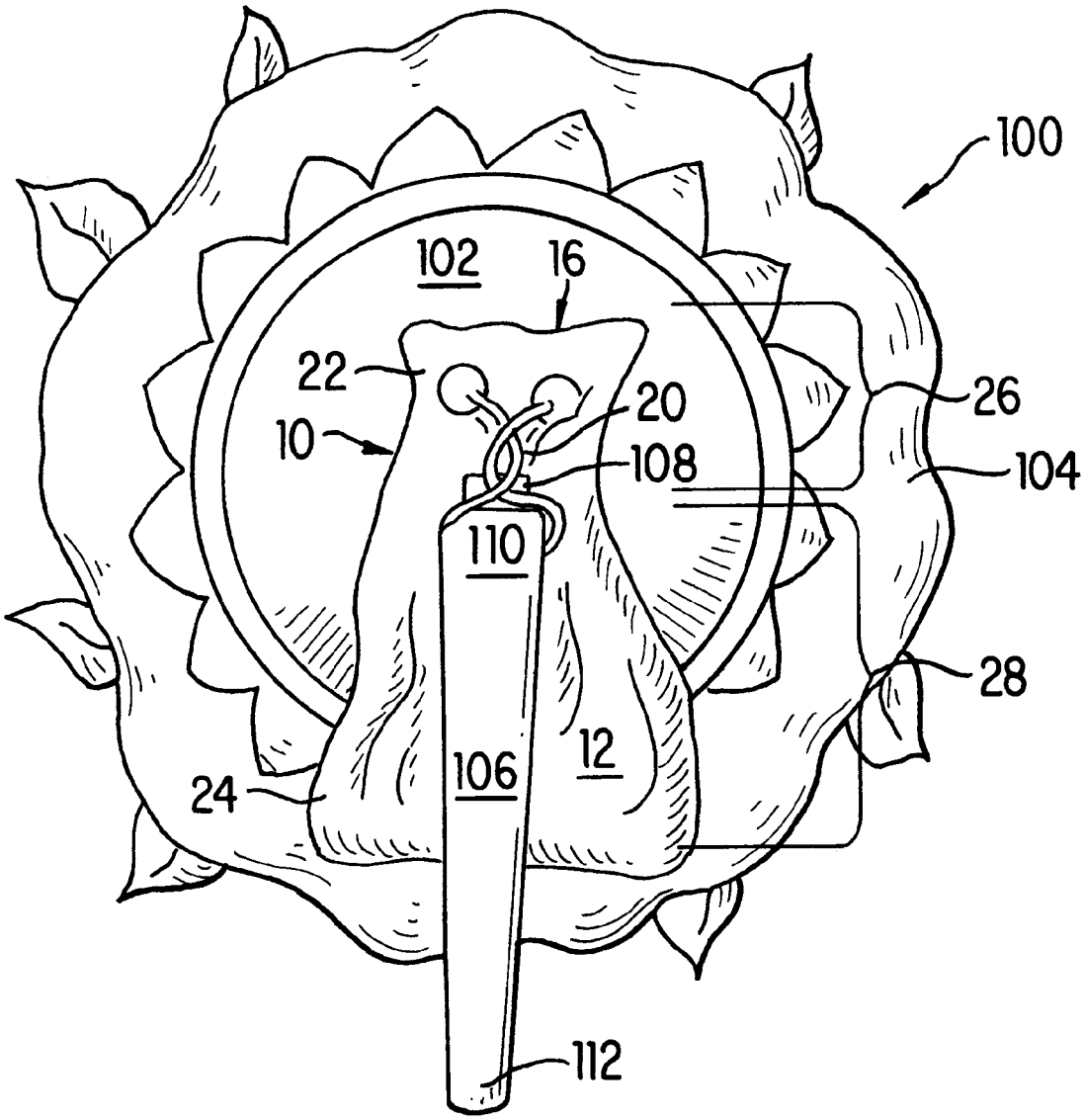
FIG. 3 is a rear view of the subject bridal accessory device having ball-and-loop attachment means.

Reference now being invited to FIG. 3, an alternate form of attachment means 20 is illustrated. Those skilled in the art will recognize this ball and loop type fastening means comprised of two elastic loops with balls attached to each at a point equidistant from the endpoints of each loop. In operation, each ball is alternately passed through the loop of its partner until no further passes are possible or until the desired degree of tightness of both loops about neck juncture 108 is achieved.

Figure 4A:
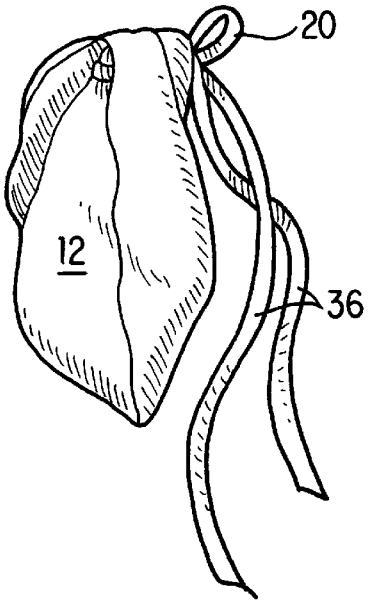
FIG. 4A is another embodiment of the subject bridal accessory device having decorative ribbon attached thereto.
Figure 4B:
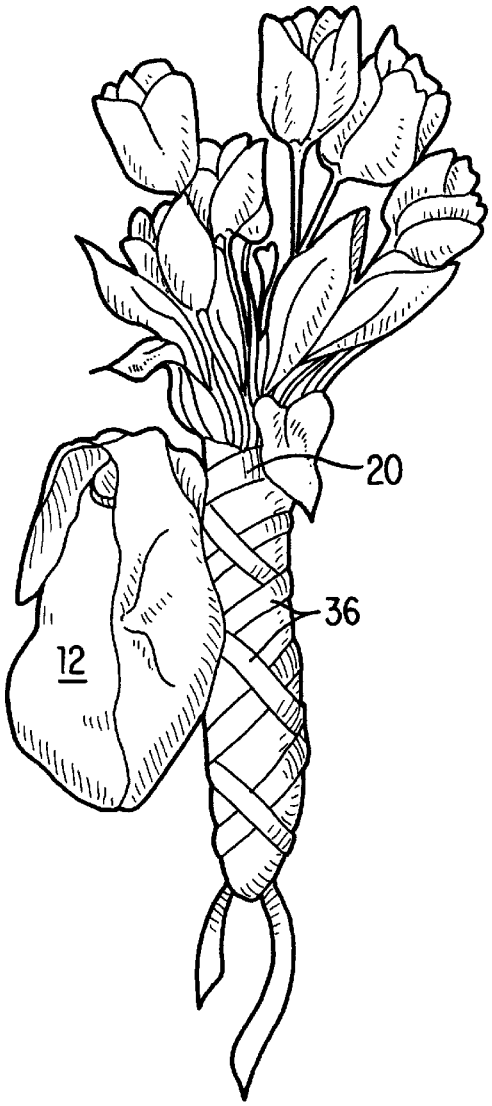
FIG. 4B illustrates the invention of FIG. 4A attached to the wrapped stems of a floral arrangement.

Referring finally to FIGS. 4A and 4B, yet another embodiment of the subject apparatus may be observed. Here, two lengths of ribbon 36 or other similar material are fixedly attached to enclosure 12 proximate to the attachment point of attachment means 20. As illustrated in FIG. 2B, the subject bridal accessory apparatus 10 is mounted to an arrangement of flowers by stretching attachment means 20 around the stems of a floral arrangement at a position just below its leaves and flowers. Once attached, ribbon 36 may be wrapped around and along the length of the stems of the flower arrangement serving not only an aesthetic function, but to bind the arrangement together as well.

Finally, while not illustrated in this application, it may be readily recognized that as an alternative to storing items in the enclosure 12 described herein, bouquet holder 100 itself may be modified to serve as a temporary housing for such items. Handle 106 may be easily molded to form a hollowed enclosure with hinged opening for the insertion of several items inside. The handle may, for instance, serve as a facial tissue dispenser without appreciatively expanding its girth. Head 102 of bouquet holder 100 may be adapted to hold a small mirror on its surface or may be adapted with a compartment for the storage of items. Those skilled in the art will readily identify numerous possible modifications to conventional bouquet holders to carry out the intended purpose of the invention described herein.

Although the present invention has been described with reference to the particular embodiments herein set forth, it is understood that the present disclosure has been made only by way of example and that numerous changes in details of construction may be resorted to without departing from the spirit and scope of the invention. Thus, the scope of the invention should not be limited by the foregoing specifications, but rather only by the scope of the claims appended hereto.

What is claimed as being new, useful and desired to be protected by Letters Patent of the United States is as follows:

1. A combination floral bouquet holder and storage apparatus comprised of:

a) a floral bouquet holder having a handle, a head portion connected to one end of said handle, and a neck juncture between said head portion and said handle;

b) a bouquet of flowers held in said head portion of said bouquet holder;

c) an enclosure having an opening for the reception of personal items within said enclosure; and d) attachment means fixedly attached to said enclosure for the removable attachment of said enclosure to the neck juncture of the bouquet holder.

2. A combination floral bouquet holder and storage apparatus comprised of:

a) a floral bouquet holder having a handle, a head portion connected to one end of said handle, and a neck juncture between said head portion and said handle;

b) a bouquet of flowers having a frontal diameter "d", said bouquet of flowers being held in said head portion of said bouquet holder;

c) an enclosure sized to be less than the frontal diameter "d" of said bouquet of flowers;

d) an opening in said enclosure for the reception of personal items within said enclosure;

e) attachment means fixedly attached to said enclosure for the removable attachment of said enclosure to the neck juncture of the bouquet holder such that said enclosure is concealed behind the bouquet of flowers; and f) retention means capable of preventing axial displacement of said attachment means along the length of the handle.

3. A combination floral bouquet holder and storage apparatus comprised of:

a) a floral bouquet holder having a handle, a head portion connected to one end of said handle, and a neck juncture between said head portion and said handle;

b) a bouquet of flowers having a frontal diameter "d", said bouquet of flowers being held in said head portion of said bouquet holder;

c) an enclosure sized to be less than the frontal diameter "d" of said bouquet of flowers;

d) an opening in said enclosure for the reception of personal items within said enclosure; and e) attachment means fixedly attached to said enclosure for the removable attachment of said enclosure to the neck juncture of the bouquet holder such that said enclosure is concealed behind the bouquet of flowers.

* * * * *